US010036085B2

(12) United States Patent
Schöttler et al.

(10) Patent No.: US 10,036,085 B2
(45) Date of Patent: Jul. 31, 2018

(54) NON-SCALING HEAT-TREATABLE STEEL AND METHOD FOR PRODUCING A NON-SCALING COMPONENT FROM SAID STEEL

(71) Applicant: Salzgitter Flachstahl GmbH, Salzgitter (DE)

(72) Inventors: Joachim Schöttler, Braunschweig (DE); Friedrich Luther, Hannover (DE); Stefan Mütze, Hannover (DE)

(73) Assignee: SALZGITTER FLACHSTAHL GMBH, Salzgitter (DE)

( * ) Notice: Subject to any disclaimer, the term of this patent is extended or adjusted under 35 U.S.C. 154(b) by 923 days.

(21) Appl. No.: 14/387,158

(22) PCT Filed: Mar. 19, 2013

(86) PCT No.: PCT/DE2013/000165

§ 371 (c)(1),
(2) Date: Sep. 22, 2014

(87) PCT Pub. No.: WO2013/139327

PCT Pub. Date: Sep. 26, 2013

(65) Prior Publication Data

US 2015/0020992 A1 Jan. 22, 2015

(30) Foreign Application Priority Data

Mar. 23, 2012 (DE) ..... 10 2012 006 470
Mar. 15, 2013 (DE) ..... 10 2013 004 905

(51) Int. Cl.
*C22C 38/00* (2006.01)
*C23C 16/00* (2006.01)
(Continued)

(52) U.S. Cl.
CPC ..... *C22C 38/58* (2013.01); *B21B 1/466* (2013.01); *B22D 11/0631* (2013.01); *C21D 1/18* (2013.01);
(Continued)

(58) Field of Classification Search
CPC ..... C22C 38/58; C22C 38/28; C22C 38/42; C22C 38/50; C22C 38/34; C22C 38/38;
(Continued)

(56) References Cited

U.S. PATENT DOCUMENTS 2,269,601 A * 1/1942 Perrin ..... C23C 8/10 148/280
3,151,978 A * 10/1964 Cameron ..... C22C 38/44 148/326
(Continued)

FOREIGN PATENT DOCUMENTS

CA 2780082 A1 * 10/2011 ..... C21D 6/00
CA 2794658 A1 * 10/2011
(Continued)

OTHER PUBLICATIONS

International Search Report issued by the European Patent Office in International Application PCT/DE2013/000165.
(Continued)

*Primary Examiner* — Kiley Stoner
(74) *Attorney, Agent, or Firm* — Henry M. Feiereisen LLC

(57) ABSTRACT

A non-scaling heat-treatable steel with particular suitability for producing hardened or die-hardened components is disclosed, characterized by the following chemical composition in % by weight: C 0.04-0.50; Mn 0.5-6.0; Al 0.5-3.0; Si 0.05-3.0; Cr 0.05-3.0; Ni less than 3.0; Cu less than 3.0; Ti 0.010-≤0.050; B 0.0015-≤0.0040; P less than 0.10; S less than 0.05; N less than 0.020; remainder iron and unavoid-
(Continued)

able impurities. Further disclosed is a method for producing a non-scaling hardened component from the steel and a method for producing a hot strip from a steel.

21 Claims, 1 Drawing Sheet

(51) Int. Cl.

| | |
|---|---|
| ***C22C 38/58*** | (2006.01) |
| ***C21D 1/74*** | (2006.01) |
| ***C21D 8/02*** | (2006.01) |
| ***C21D 9/08*** | (2006.01) |
| ***C21D 9/52*** | (2006.01) |
| ***C21D 1/18*** | (2006.01) |
| ***C21D 1/34*** | (2006.01) |
| ***B22D 11/06*** | (2006.01) |
| ***B21B 1/46*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/28*** | (2006.01) |
| ***C22C 38/32*** | (2006.01) |
| ***C22C 38/34*** | (2006.01) |
| ***C22C 38/38*** | (2006.01) |
| ***C22C 38/42*** | (2006.01) |
| ***C22C 38/50*** | (2006.01) |
| ***C22C 38/54*** | (2006.01) |
| *B22D 11/12* | (2006.01) |
| *B22D 11/126* | (2006.01) |

(52) U.S. Cl.
CPC ..... *C21D 1/34* (2013.01); *C21D 1/74* (2013.01); *C21D 8/0226* (2013.01); *C21D 9/08* (2013.01); *C21D 9/52* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/28* (2013.01); *C22C 38/32* (2013.01); *C22C 38/34* (2013.01); *C22C 38/38* (2013.01); *C22C 38/42* (2013.01); *C22C 38/50* (2013.01); *C22C 38/54* (2013.01); *B22D 11/126* (2013.01); *B22D 11/1206* (2013.01); *C21D 2211/001* (2013.01); *C21D 2241/00* (2013.01); *Y10T 29/49991* (2015.01)

(58) Field of Classification Search
CPC ..... C22C 38/001; C22C 38/002; C22C 38/02; C22C 38/04; C22C 38/06; C22C 38/20; C22C 38/54; C22C 38/32; B21B 1/466; B22D 11/0631; B22D 11/126; B22D 11/1206; C21D 8/0226; C21D 1/34; C21D 1/18; C21D 9/08; C21D 2241/00; C21D 2211/001; C21D 9/52; C21D 1/74; Y10T 29/49991
USPC ..... 420/8–129; 148/217, 272
See application file for complete search history.

(56) References Cited

U.S. PATENT DOCUMENTS 3,459,539 A * 8/1969 Bassford ..... C22C 19/05 148/327
4,126,447 A * 11/1978 Costello ..... C22C 38/44 420/43
4,206,004 A * 6/1980 Ohashi ..... C21D 1/70 148/113
4,741,880 A 5/1988 Lang et al.
4,793,168 A * 12/1988 Kimura ..... B21B 1/463 29/527.7
5,055,018 A * 10/1991 Ototani ..... C21C 7/0006 420/8
5,225,156 A * 7/1993 Ototani ..... C21C 7/0006 420/103
5,462,611 A * 10/1995 Uematsu ..... C22C 38/26 148/325
5,647,922 A * 7/1997 Kim ..... C21D 8/0205 148/530
6,475,310 B1 * 11/2002 Dunning ..... C21D 6/004 148/272
6,564,604 B2 5/2003 Kefferstein et al.
7,909,085 B2 * 3/2011 Benedetti ..... B21B 1/463 164/417
8,047,263 B2 11/2011 Spitzer et al.
9,315,887 B2 * 4/2016 Fushiwaki ..... C23C 2/28
9,677,148 B2 * 6/2017 Tanaka ..... C21D 9/46
2003/0178110 A1 * 9/2003 Wehage ..... B21B 1/26 148/567
2004/0096299 A1 * 5/2004 Sudau ..... B21B 1/466 414/147
2006/0292391 A1 * 12/2006 Ikematsu ..... C22C 38/02 428/659
2007/0107816 A1 * 5/2007 Frommeyer ..... C22C 38/008 148/612
2007/0113610 A1 * 5/2007 Rittner ..... B21B 1/466 72/202
2008/0028813 A1 * 2/2008 Arvedi ..... B21B 45/004 72/226
2009/0173412 A1 7/2009 Schoettler et al.
2009/0229710 A1 * 9/2009 Kuroda ..... B21B 45/00 148/287
2009/0242086 A1 10/2009 Thomas et al.
2009/0280350 A1 * 11/2009 Inaguma ..... C21D 8/0226 428/609
2010/0059196 A1 * 3/2010 Spitzer ..... B21B 1/26 164/462
2010/0116456 A1 * 5/2010 Benedetti ..... B21B 13/22 164/454
2010/0218856 A1 * 9/2010 Hamada ..... C21D 9/46 148/326
2010/0275667 A1 * 11/2010 Seidel ..... B21B 1/46 72/127
2011/0024004 A1 * 2/2011 Azuma ..... C21D 8/0236 148/533
2011/0024006 A1 2/2011 Schoettler et al.
2011/0123387 A1 * 5/2011 Kato ..... C22C 38/001 420/40
2011/0217569 A1 * 9/2011 Fushiwaki ..... C22C 38/02 428/659
2011/0253263 A1 * 10/2011 Fushiwaki ..... C21D 6/005 148/505
2011/0300404 A1 * 12/2011 Goller ..... B32B 15/013 428/650
2011/0300405 A1 * 12/2011 Goller ..... C23C 10/20 428/650
2011/0300454 A1 * 12/2011 Goller ..... C23C 10/20 429/400
2012/0090737 A1 * 4/2012 Fushiwaki ..... C21D 1/26 148/533
2012/0152411 A1 * 6/2012 Morimoto ..... B22D 11/115 148/533
2012/0279621 A1 11/2012 Gerber et al.
2012/0305139 A1 12/2012 John et al.
2013/0008573 A1 * 1/2013 Hamada ..... C21D 6/002 148/609
2013/0048150 A1 * 2/2013 John ..... C21D 6/005 148/278
2013/0202801 A1 * 8/2013 Suzuki ..... C21D 1/76 427/329
2013/0272913 A1 * 10/2013 Takeda ..... C21D 1/74 420/84

(56) References Cited

U.S. PATENT DOCUMENTS

| | | | | |
|---|---|---|---|---|
| 2014/0007993 | A1* | 1/2014 | Nakajima | C21D 6/00 148/602 |
| 2014/0242415 | A1* | 8/2014 | Azuma | C23C 2/06 428/659 |
| 2014/0373980 | A1* | 12/2014 | Hayashi | C21D 9/46 148/503 |
| 2015/0013845 | A1* | 1/2015 | Georgeou | C21D 8/12 148/111 |
| 2015/0020933 | A1* | 1/2015 | Hamada | C21D 9/46 148/603 |
| 2015/0203949 | A1* | 7/2015 | Yokoi | C21D 8/0205 428/659 |

FOREIGN PATENT DOCUMENTS

| | | | | |
|---|---|---|---|---|
| DE | 2922737 | A1 * | 12/1980 | B32B 15/011 |
| DE | 36 04 789 | | 8/1987 | |
| DE | 102004062636 | | 7/2006 | |
| DE | 601 19 826 | | 12/2006 | |
| DE | 699 33 751 | | 10/2007 | |
| EP | 0 231 570 | | 8/1987 | |
| EP | 2 374 910 | | 10/2011 | |
| EP | 2374910 | A1 * | 10/2011 | C21D 6/00 |
| GB | 783955 | A * | 10/1957 | C22C 19/055 |
| JP | H10-212560 | | 8/1998 | |
| JP | 2007-191746 | A1 * | 8/2007 | |
| SU | 1125280 | A * | 11/1984 | |
| WO | WO 2011121118 | A2 * | 10/2011 | C21D 6/00 |

OTHER PUBLICATIONS

Braun et al., U.S. Pat. No. 8,404,061, Mar. 26, 2013, 2012-0107632, May 3, 2012

* cited by examiner

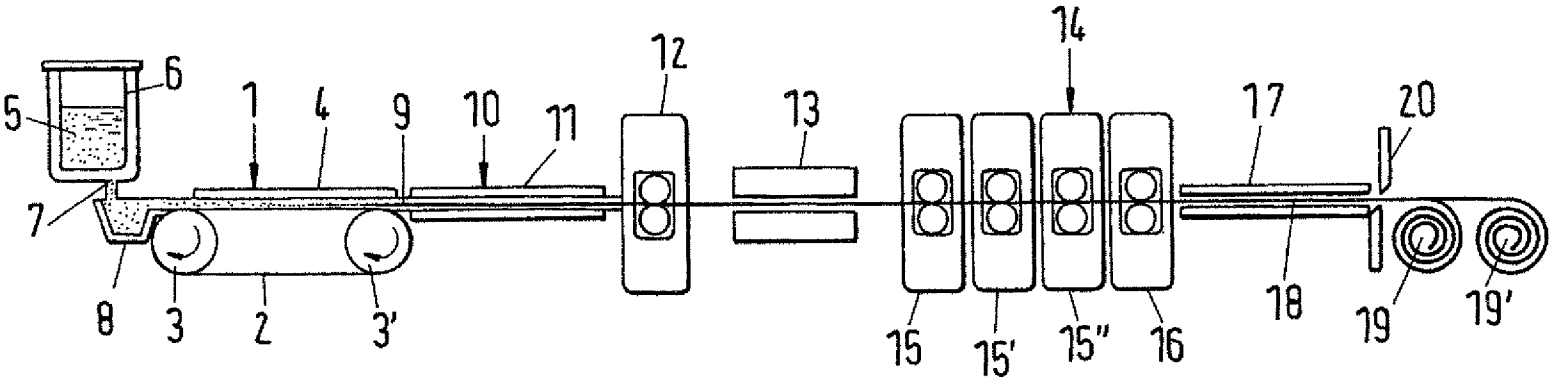
1
2
3
3'
4
5
6
7
8
9
10
11
12
13
14
15
15'
15"
16
17
18
19
19'
20

NON-SCALING HEAT-TREATABLE STEEL AND METHOD FOR PRODUCING A NON-SCALING COMPONENT FROM SAID STEEL

CROSS-REFERENCES TO RELATED APPLICATIONS

This application is the U.S. National Stage of International Application No. PCT/DE2013/000165, filed Mar. 19, 2013, which designated the United States and has been published as International Publication No. WO 2013/139327 and which claims the priority of German Patent Application, Serial No. 10 2012 006 470.5, filed Mar. 23, 2012, and German Patent Application, Serial No. 10 2013 004 905.9, filed Mar. 15, 2013 pursuant to 35 U.S.C. 119(a)-(d).

BACKGROUND OF THE INVENTION

The invention relates to a non-scaling heat treatable steel. The invention also relates to a method for producing a non-scaling component according to claim 5 and the production of a strip made of this steel.

Such components are produced from pre-products such as sheet metals, metal plates seamless or welded tubes and are mainly used in the automobile industry, but also in the agricultural machine construction for example for plowshare, in the construction industry, for example for wear plates or in wind energy systems for example as support structures.

As is known, heat treatment of a component is achieved by austenizing, quenching and subsequent tempering of the steel material, wherein depending on the field of use, components are also used solely in the hardened, i.e., non-tempered state.

The hotly contested market of the automobile industry forces automobile producers to constantly seek solutions for lowering the fleet consumption while maintaining a highest possible comfort and passenger protection. In this regard the weight saving of all vehicle components plays an important role in one hand, but on the other hand also a most advantageous behavior of the individual components at high static and dynamic stress during operation and in the event of a crash.

Suppliers of starting materials seek to account for this requirement by making available high and ultra-high strength steels thereby enabling reducing the wall thicknesses while at the same time improving component behavior during manufacture and during operation.

These steels therefore have to meet relatively high demands regarding strength, ductility, tenacity, energy absorption capacity and corrosion resistance as well as regarding their processability for example during cold forming and during welding.

In light of the aforementioned aspects the production of components from hot formable and press hardened steels gains increasing importance because these ideally satisfy the increased demands on the component properties at low material costs.

The production of press hardened components by means of quenching of pre: products made of press hardenable steels by hot forming in a forming tool is known from DE 601 19 826 T2. Here a steel plate which is heated beforehand to above austenizing temperature to 800-1200° C. and provided with a coating of zinc or zinc basis is formed in a tool, which in some cases may be cooled, to a component wherein the sheet metal or component is subjected during the forming to a quenching (press hardening) by fast heat withdrawal and thereby achieves the demanded strength properties. The metallic coating here acts as oxidation or scale protection.

The production of components by means of quenching of pre-products made of press hardenable steels by hot forming in a forming tool is also known from DE 699 33 751 T2. Here, a steel sheet is coated with a metallic coating made of an aluminum alloy, heated prior to a forming to above 700° C., wherein an intermetallic alloyed compound on the basis of iron, aluminum and silicone is generated on the surface and the sheet metal is then formed and cooled with a rate above the critical hardening speed. The metallic coating also in this case acts a oxidation or scaling protection.

The application of oxidation or scaling protection onto the pre: product to be formed prior to the heating to forming temperature is advantageous in the known press form hardening because the coating allows effectively avoiding or even preventing scaling of the basic material and tool wear.

Without such a protection the heated pre-products would scale when coming into contact with oxygen of the atmosphere and the tools would be exposed to strong wear. The industrially used heating furnaces are usually operated with an atmosphere that is not oxidizing for iron, however when the plate is transported from the furnace into the die a strong scaling occurs at the ambient atmosphere. Prior to further processing the components have to be descaled by costly blasting.

The metallic coating, which acts as oxidation or scaling protection, is usually applied to the hot or cold strip in the continuous process. In hot dip coatings this can for example be a hot dip galvanizing or hot dip aluminizing. It is also known to use a varnish based non-metallic coating instead of a metallic coating. It is also known to use an electrolytically deposited metallic layer made of zinc and nickel.

Known hot formable heat treatable steels for use in the automobile industry are for example the known manganese boron steel "22MnB5" and recently also air-hardenable steels according to a still unpublished patent application of the applicant.

The production of such components by press form hardening of pre-products form the known materials has however several disadvantages.

When a coating or a cover for avoiding scaling is desired during heating to forming temperature, the production costs significantly increase for such steels. In addition resources are used up and the environment is negatively affected by the increased energy consumption.

Because the forming above $A_{C3}$ temperature is usually significantly above 800° C., extremely high demands are also placed on the temperature resistance of a protection against scaling. In case of a protection against scaling on zinc basis there is also the risk of liquid metal embrittlement.

A disadvantage is also the processing of press hardenable steels with a coating or a cover in and of itself because certain holding or furnace times have to be observed during heating to forming temperature, which limits the flexibility in the process sequence on the customer side. In addition the scrap rates increase, because for example a plate an no longer be used when due to malfunction the furnace time is increased.

But also in the case of pre-products that are brought into a hardened or tempered condition solely via a corresponding temperature profile without forming and are subsequently further processed to a component, the scaling of the work piece surface has to be laboriously prior to further processing, which also significantly increases production costs.

From DE 36 04 789 C1 heat treatable steels are known which have the problem that at Al contents of more than 0.015% the required austenizing temperatures with 950 to 1050° C. are very high and with this a strong scaling is associated. In order to ensure the hardenability also at lower temperatures zircon is added to the steel in amounts that are adjusted to the nitrogen content, in order to prevent aluminum nitride precipitations in the steel, which were recognized as negatively influencing sufficient hardenability. The heat treatable steels A-H with good heat treatable properties tested there in table 1 have the following alloy composition in weight %: C: 0.32-0.75, Si: 0.26-0.37, Mn: 0.40-1.50, P: 0.009-0.012, Si: 0.005-0.012, Al: 0.016-0.022, Cr: 0.02-1.52, Zr: 0.035-0.060, N: 0.0042-0.0065.

SUMMARY OF THE INVENTION

An object of the invention is to set forth a heat treatable steels, which is characterized by a very low scale propensity without coating or cover and hereby obviates a subsequent removal of the scale prior to further processing. In particular this heat treatable steel is also to be suited for press form hardening of pre-products such as steel sheets, steel plates or tubes.

A further object is to set forth a method for producing a non-scaling component made of this steel.

In addition an appropriate production method for producing a meal strip as pre-product made of this steel is to be set forth.

According to the teaching of the invention, a heat treatable steel is used having the following composition in weight %:

C: 0.04-0.50
Mn: 0.5-6.0
Al: 0.5-3.0
Si: 0.05-3.0
Cr: 0.05-3.0
Ni: less than 3.0
Cu: less than 3.0
Ti: 0.010-≤0.050
B: 0.0015-≤0.0040
P: less than 0.10
S: less than 0.05
N: less than 0.020
remainder iron and unavoidable impurities.

The material according to the invention has compared to the heat treatable steel known from DE 601 19 826 T2 the advantage that an additional oxidation protection prior to the press form hardening is no longer required.

As a result an additional production step is saved which lowers the overall production costs for a hardened or press hardened component in spite of the higher alloying costs and in addition resources are saved.

In addition a possible liquid metal embrittlement of the component by omitting a zinc based oxidation protection coating can be avoided.

In contrast to the heat treatable steels known from DE 36 04 789 C1 unusually high contents of aluminum with optionally up to 3 weight % increased silicone and chromium contents are added for heat treatable steels, which increase as ferrite formers the transformation temperature $A_{C3}$ and with this the required austenizing temperature, which however realize an excellent scale protection. Disadvantages however are longer heating up and with this cycle times in a press from hardening because higher temperatures have to be reached which lowers productivity.

For overcoming these disadvantages it is therefore provided according to the invention that the transformation temperature $A_{C3}$ is significantly lowered again by addition of the austenite former manganese in the contents according to the invention of 0.5 to 6 weight %.

Also addition of nickel at contents of up to 3.0 weight %, advantageously in combination with copper at contents of up to 3.0 weight % also cause a lowering of the austenizing temperature and can additionally be added to the steel in addition to Mn. When nickel and/or copper are added to lower the austenizing temperature the addition should not fall below in each case 0.05 weight % in order to provide sufficient effect.

The sum of the amount of manganese, nickel and copper together should not fall below a value of 1.0 weight %, better 2.0 weight %, optimally 3.0 weight %.

While nickel generally has a very strong effect on the transformation temperatures but is relatively expensive, copper significantly reduces the transformation temperatures, in particular in high aluminum content steel, and is relatively cost effective. Optimally, Cu is added in combination with Ni to thereby avoid copper related surface defects that may occur such as hot shortness.

The very low scaling tendency of the material during heating is achieved in that the steel according to the invention with 0.5% to 3.0 weight % has a much higher content of the oxygen affine element aluminum compared to known heat treatable steels and in addition optionally increased contents of the also oxygen affine elements silicone and/or chromium. In order to achieve a sufficient effect the overall total content of aluminum, silicone and chromium should be at least 1.0 weight %, better 2.0 weight %, optimally 3.0 weight %.

Tests have surprisingly shown in that when heating to forming or hardening temperature in an appropriate furnace atmosphere, in particular a thick layer of $Al_2O_3$ forms on the surface of the heated pre-product, which effectively lowers or even completely inhibits a scaling of the iron in the steel. In the case of a conventional heating in an atmosphere that is not oxidizing for iron the $Al_2O_3$ layer inhibits scaling during the transfer of the plate at ambient atmosphere from the furnace to the pressing die.

It should be noted however that for achieving an oxide layer which is as homogenous as possible and a good protection against scaling an appropriate annealing atmosphere has to be present.

The heat treatable steel according to the invention thus has an intrinsic scaling protection, which obviates an additional coating as scaling protection or a subsequent removal of scale prior to further processing.

According to the invention, titanium at contents of 0.010-≤0.050% and boron at contents of 0.0015-≤0.0040% are added.

The element boron cause an improvement of the hardenability of the steel due to an advantageous shift of the relevant transformation points. This is additionally promoted by adding titanium, in that the nitrogen present in the steel is bound to titanium nitrides. In this way boronitride precipitations are avoided and the effectiveness of the added boron improved.

Tests have shown that the formation of a layer, which inhibits scaling on the work piece surface can be significantly influenced by the annealing atmosphere during the heating. Tests have also shown that in the case of excessive oxygen or humidity in the furnace atmosphere increasingly manganese oxides form from the manganese contained in the steel, which only offer an insufficient scaling protection.

For forming a scaling inhibiting layer of aluminum, silicone and chromium-oxides during the heating to hardening or forming temperature, it has proven advantageous to lower the oxygen content or the humidity in a nitrogen containing furnace atmosphere which optionally can also contain hydrogen, carbon monoxide and carbon dioxide, so that the dew point is advantageously below 0° C. because at low oxygen contents or low dew points the elements such as aluminum or silicone or chromium which are more oxygen affine than manganese oxidize increasingly on the work piece surface and form oxide films.

It is particularly advantageous when the dew point is lowered to below −10° C. or even below −20° C. or even below −30° C. so that a stable and dense layer of advantageous aluminum oxides and optionally also silicone and chromium oxides is formed on the surface of the heated pre-product. The lowering of the dew point is advantageously achieved by using nitrogen with a correspondingly low moisture content.

It is known that in the case of increased contents of aluminum or silicone above 2.0 weight % the casting with known methods (strip casting, thin slab casting) can be complicated by occurring macro segregation, casting powder inclusions or bending of the strip during solidification.

In an advantageous configuration of the invention it is therefore provided that the production of steel strip with the alloy composition according to the invention advantageously occurs on a horizontal strip casting system known from DE 10 2004 062 636 A1 in which macro segregations and blowholes are avoided to the most degree due to very homogenous cooling conditions.

Because no casting powder is used in these systems, the problems related to casting powder do not arise.

For the strip casting process it is proposed that the melt is cast in a horizontal strip casting system under calm flow and free of bending to form a pre-strip in the range between 6 and 30 mm and is subsequently rolled to hot strip with a degree of deformation of at least 50%.

The calm flow is achieved in that an electromagnetic brake is used which moves along with the strip and generates an electromagnetic field which moves synchronously or at an optimal relative speed along with the strip and which ensures ideally that the speed at which the melt is supplied equals the speed of the rotating conveyor belt. Bending of the solidifying pre-strip which is regarded as disadvantageous is prevented in that the bottom side of the casting belt, which receives the melt, is supported on multiple adjacently arranged rollers. The supporting effect is increased in that a vacuum is generated in the region of the casting belt so that the casting strip is firmly pressed onto the rollers. In order to maintain the required conditions during the critical phase of the solidification, the length of the conveyor belt is selected so that at the end of the conveyor belt prior to its redirection the pre-strip is solidified to the most degreed.

At the end of the conveyor belt follows a homogenization zone, which is used for temperature compensation and possible tension reduction in the pre-strip.

The rolling of the pre-strip into a hot strip can either occur in-line or separately off-line. After production of the pre-strip, prior to the off-line rolling and cooling, the pre-strip can be either directly coiled or cut into plates. After a possible cooling the strip or plate material is then reheated and uncoiled for the off-line rolling or reheated as plate and rolled.

BRIEF DESCRIPTION OF THE DRAWING

The sole FIGURE in the appendix schematically shows a method sequence according to the invention for the condition casting speed=rolling speed.

DETAILED DESCRIPTION OF PREFERRED EMBODIMENTS

The casting method with a horizontal strip casting system 1 is located upstream of the hot rolling process, and is composed of a rotating conveyor belt 2 and two deflector rolls 3, 3'. A lateral sealing 4 can also be seen which prevents that the applied melt 5 flows off the conveyor belt to the right hand or left hand side. The melt 5 is transported to the strip casting system 1 by means of a pan 6 and flows through an opening 7 provided in the bottom of the pan into a supply container 8. This supply container 8 is constructed in the manner of an overflow.

Not shown are the devices for intensive cooling of the bottom of the upper tower of the conveyor belt 2 and the complete housing of the strip casting system 1 with corresponding inert gas atmosphere.

For temperature compensation and tension reduction a homogenization zone 10 adjoins the strip casting system 1. The homogenization zone includes a heat insulating housing 11 and a here not shown roller table.

The first stand 12 following thereafter is either configured only as pure drive unit optionally with a small pass or a roller unit with a predetermined pass.

Following is an intermediate heating, here preferably as inductive heating for example configured in the form of a coil 13. The actual hot forming occurs in the subsequent stand array 14, wherein the first three stands 15, 15', 5" cause the actual pass reduction, while the last stand 16 is configured as smoothening stand.

Following the last pass is a cooling zone 17, in which the hot strip is cooled down to coiling temperature.

Between the end of the cooling distance 17 and the coiling 19, 19' a scissor 20 is arranged. This scissor 20 has the purpose to separate the hot strip 18 transversely as soon as the one of the two coils 19, 19' is fully wound up. The beginning of the following hot strip 18 is then guided onto the second released coil 19, 19'. This ensures that the tension on the strip is maintained over the entire strip length. This is particularly important when producing thin hot strips.

Not shown in the FIGURE are the system components for cold rolling of the hot strip.

| No. | Designation |
|---|---|
| 1 | Strip casting system |
| 2 | Conveyor belt |
| 3, 3' | Deflector roller |
| 4 | Lateral sealing |
| 5 | Melt |
| 6 | Pan |
| 7 | Opening |
| 8 | Supply container |
| 9 | Pre-strip |
| 10 | Homogenization zone |
| 11 | Housing |
| 12 | First stand |
| 13 | Induction coil |
| 14 | Stand array |
| 15, 15', 15" | Roller stand |
| 16 | Smoothing stand |
| 17 | Cooling distance |
| 18 | Finished hot strip |

-continued

| No. | Designation |
|---|---|
| 19, 19' | Coil |
| 20 | Scissor |

The invention claimed is:

1. A method for producing a component from steel comprising:

heating a pre-product comprising a following chemical composition in weight %:

C: 0.04-0.50
Mn: 0.5-6.0
Al: >1.5-≤3.0
Si: 0.05-3.0
Cr: 0.05-3.0
Ni: less than 3.0
Cu: less than 3.0
Ti: 0.010-≤0.050
B: 0.0015-≤0.0040
P: less than 0.10
S: less than 0.05
N: less than 0.020, remainder iron and unavoidable impurities, in a nitrogen-containing atmosphere to austenizing temperature;

lowering an oxygen content or humidity in the nitrogen-containing atmosphere to a level sufficient to keep a dew point at below 0° C. and to form a layer of $Al_2O_3$ on a surface of the heated pre-product and thereby effectively inhibit scaling of iron in the pre-product; and quenching the pre-product.

2. The method of claim 1, wherein the level of the oxygen content or humidity in the nitrogen-containing atmosphere is such as to keep the dew point below −10° C.

3. The method of claim 1, wherein the level of the oxygen content or humidity in the nitrogen-containing atmosphere is such as to keep the dew point below −20° C.

4. The method of claim 1, wherein the level of the oxygen content or humidity in the nitrogen-containing atmosphere is such as to keep the dew point below −30° C.

5. The method of claim 1, wherein the heating to austenizing temperature is realized through induction, conduction, or radiation.

6. The method of claim 1, Fan hot or cold rolling a sheet metal to produce the pre-product.

7. The method of claim 1, further comprising seamlessly hot rolling a tube to produce the pre-product.

8. The method of claim 1, further comprising:

casting a melt to a pre-strip in a horizontal strip casting system; and hot rolling the pre-strip to form the pre-product with a deformation degree of at least 50%.

9. The method of claim 8, further comprising supplying the melt onto a rotating conveyor belt of the horizontal strip casting system at a speed which equals a speed of the rotating conveyor belt.

10. The method of claim 8, further comprising evenly cooling all surface areas of the pre-strip, across a width of the conveyor belt so as to substantially fully solidify the ore-strip when exiting the conveyor belt.

11. The method of claim 10, further comprising after full solidification of the pre-strip, passing the pre-strip through a homogenization zone.

12. The method of claim 11, further comprising cutting the pre-strip into plates after undergoing homogenization.

13. The method of claim 12, further comprising after cutting the pre-strip to plates, heating the plates to rolling temperature and subsequently rolling the plates.

14. The method of claim 11, further comprising coiling the pre-strip after undergoing homogenization.

15. The method of claim 14, further comprising after the coiling uncoiling the pre-strip, heating the pre-strip to rolling temperature and rolling the pre-strip.

16. The method of claim 15, wherein the pre-strip is reheated prior to the uncoiling.

17. The method of claim 8, further comprising subjecting the pre-strip to the rolling process in-line and subsequently coiling the pre-strip.

18. The method of claim 8, wherein the deformation degree during rolling is >70%.

19. The method of claim 8, wherein the deformation degree during rolling is >90%.

20. The method of claim 10, further comprising cold rolling the pre-strip after the cooling.

21. The method of claim 1, wherein the nitrogen containing atmosphere contains $H_2$, CO and $CO_2$.

* * * * *